United States Patent [19]

Race

[11] Patent Number: 4,869,388

[45] Date of Patent: Sep. 26, 1989

[54] METAL TREATMENT VESSEL AND METHOD

[75] Inventor: Bryan Race, Crawley, England

[73] Assignee: Materials and Methods Limited, Surrey, England

[21] Appl. No.: 232,086

[22] Filed: Aug. 15, 1988

[30] Foreign Application Priority Data

Aug. 19, 1987 [GB] United Kingdom ..... 8719543

[51] Int. Cl.[4] ..... B65D 1/24

[52] U.S. Cl. ..... 220/20.5; 266/230; 266/275; 222/598

[58] Field of Search ..... 220/20.5, 83; 266/901, 266/275, 230; 222/598, 602

*Primary Examiner*—A. Michael Chambers

*Attorney, Agent, or Firm*—Armstrong, Nikaido, Marmelstein, Kubovcik & Murray

[57] ABSTRACT

A metal treatment vessel having an inlet for the successive introduction of reactive additive and molten metal to be treated, a reaction chamber downstream of the flow of molten metal for successive receipt of the additive and the molten metal and an outlet downstream of the flow of metal in the reaction chamber; the inlet being provided with means for directing the additive and molten metal into the reaction chamber, the dimensions of the inlet to the reaction chamber and the outlet therefrom being such that in operation the molten metal rises in an overhead space provided in the reaction chamber to cover the additive and to seal off the inlet.

Retaining means may be provided within the reaction chamber to retain the additive against the flow of molten metal. The inlet at the point of entry into the chamber is preferably at an angle to the vertical whereby the additive and molten metal are deflected into the reaction chamber. There is also provided a method for the treatment of a metal with a reactive additive which comprises introducing the additive into a closed reaction vessel at an angle to the vertical, the vessel having an inlet and an outlet, and a free overhead space, the outlet from the vessel being of smaller area than the inlet, retaining the additive in the vessel, introducing molten metal to be treated also at an angle to the vertical whereby it reacts with the retained additive and allowing the treated metal to run from the reaction vessel, optionally after retaining the treated metal in the reaction chamber for a predetermined period of time.

12 Claims, 3 Drawing Sheets

METAL TREATMENT VESSEL AND METHOD

This invention relates to a vessel in which a metal may be treated and to a method of treatment utilizing such a vessel. In particular, it relates to a vessel for carrying out treatment of a metal, such as liquid iron, with an alloy which effects a change in the characteristics of the metal, for example a magnesium containing alloy. As is known the use of such an alloy may change the structure of the carbon, and depending upon the amount of alloy used, the carbon may appear in the cast iron as spheroidal (nodular) or vermicular graphite.

In GB-PS 1,311,093, there is described and claimed a process and apparatus for the treatment of molten metals. In the apparatus described in that specification the additive with which the molten metal is to be treated is introduced into a reaction chamber provided with a separate inlet for the molten metal. In operation, a removable lid has to be removed before additive is positioned in the reaction chamber and then has to be replaced before the molten metal is run into the reaction chamber. This operation may have to be conducted under high temperature conditions and can lead to complications. Also if a highly reactive additive is used, the reaction, on introduction of the molten metal, may be explosive and blow back may occur.

In EP 0006306, there is disclosed an apparatus for the treatment of molten metal wherein the additive with which the molten metal is to be treated and the molten metal are introduced successively through the same inlet directly into a reaction chamber the apparatus being so dimensioned that in operation the additive is always covered by molten metal. Again, after successive runs the chamber into which the additive is introduced may become very hot. If a very reactive additive is used there is a risk of blow back through the inlet due to a violent reaction.

In the treatment of molten iron with a magnesium alloy it is conventional to use a magnesium ferrosilicon alloy. The higher the percentage of magnesium the more reactive the alloy. However, the use of a low magnesium alloy is less desirable because of the silicon and other constituents of the alloy which are introduced into the iron being treated. In the process just described high magnesium alloys can be dangerous because of their reactivity.

It is an object of the present invention to provide an apparatus for the treatment of molten metal in which a highly reactive additive such as a magnesium containing alloy can be used without the attendant disadvantages referred to above, and with which apparatus recovery of the additive in the sense of its utilization is improved.

In principle this is achieved by the utilization of an apparatus provided with an inlet for successive introduction of reactive additive and molten metal wherein the inlet directs the additive and the molten metal into a connected reaction chamber with a large overhead space and in operation the molten metal rises to a level in the chamber which effectively prevents blow back through the inlet taking place.

According to the present invention, there is provided a metal treatment vessel having an inlet for the successive introduction of reactive additive and molten metal to be treated, a reaction chamber downstream of the flow of molten metal for successive receipt of the additive and the molten metal and an outlet downstream of the flow of metal in the reaction chamber; the inlet being provided with means for directing the additive and molten metal into the reaction chamber, the dimensions of the inlet to the reaction chamber and the outlet therefrom being such that in operation the molten metal rises in an overhead space provided in the reaction chamber to cover the additive and to seal off the inlet.

With such a metal treatment vessel the risk of "blowback" of molten metal and reaction vapor is reduced because the reaction vapor rises vertically from the additive to the-space provided above the level of molten metal which is sufficiently large to absorb all the vapor which is likely to result from the reaction. The inlet for introducing the molten metal and additive ensures that the additive comes to rest away from the end of the inlet opening into the reaction chamber thus diverting the reaction away from the inlet and preventing the vapor from escaping backwards through the inlet. The level of molten metal is maintained at a certain height within the vessel to prevent the vapor from entering the inlet.

By incorporating a stopper rod in such a treatment vessel the flow of liquid metal can be delayed for a period which allows the reaction products to rise to the surface. Of the molten metal within the reaction chamber. In this way, the flow from the outlet will be free from reaction products and the flow is said to be "clean".

Preferred embodiments of the present invention will now be described in detail by way of example only with reference to the accompanying drawings, in which.

Figure 1:
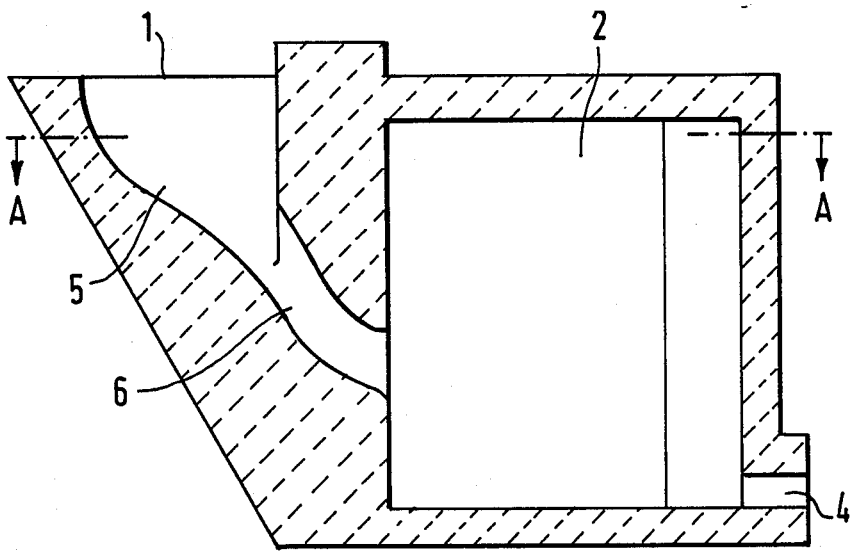
FIG. 1 is a vertical cross-section of a metal treatment vessel according to the present invention.

FIG. 1 shows a metal treatment vessel having an inlet for the successive introduction of an additive and a liquid metal to be treated. A reaction chamber 2 is provided downstream of the metal flow and an outlet 4 is situated downstream of the flow of molten metal through the reaction chamber 2. The cross-section of the inlet 5 is larger than that of the outlet 4 to ensure that the level of molten metal within the chamber is sufficient to cover the end of the inlet 5 at the entrance to the reaction chamber 2. In this way, the reaction vapor which results from the reaction between the additive and molten metal rises and expands into a space provided above the molten metal level rather than passing back through inlet 5 to cause "blowback" of liquid metal. At the point of entry 6 into the reaction chamber the inlet 5 is at an angle to the vertical. In this particular figure the inlet 5 is also inclined to the vertical at a smaller angle than at the point of entry into the reaction chamber 2. However, it is possible to have a vertical inlet 5 with an incline 6 only at the point of entry into the reaction chamber 2. When an additive is introduced to the vessel, it will be deflected from the inclined surface 6 such that it is thrown into the reaction chamber 2. If the additive is situated as far from the inlet 5 as possible there is a reduced risk of a reaction occurring close to the entrance into the reaction chamber 2 which in turn ensures that reaction vapor will not rise up through the inlet 5. The inlet 5 is further provided with a mouth 1.

Figure 2:
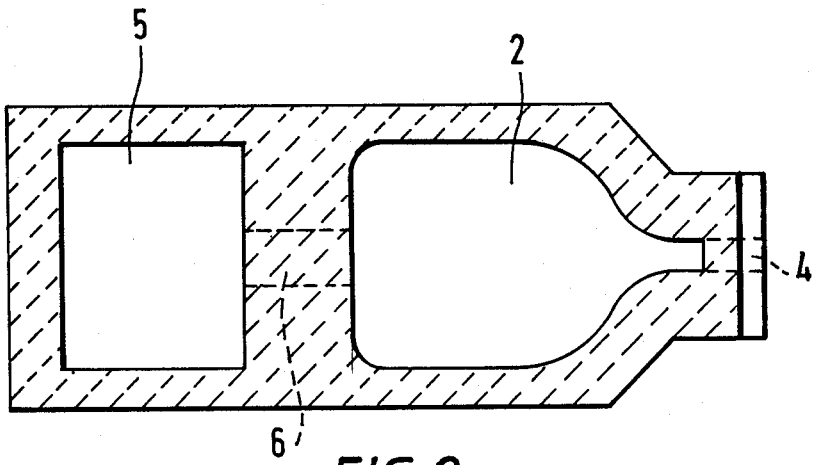
FIG. 2 is a view through section A—A of FIG. 1.

FIG. 2 shows the vessel of FIG. 1 along section A—A with the inlet 5 and connected reaction chamber 2.

Figure 3:
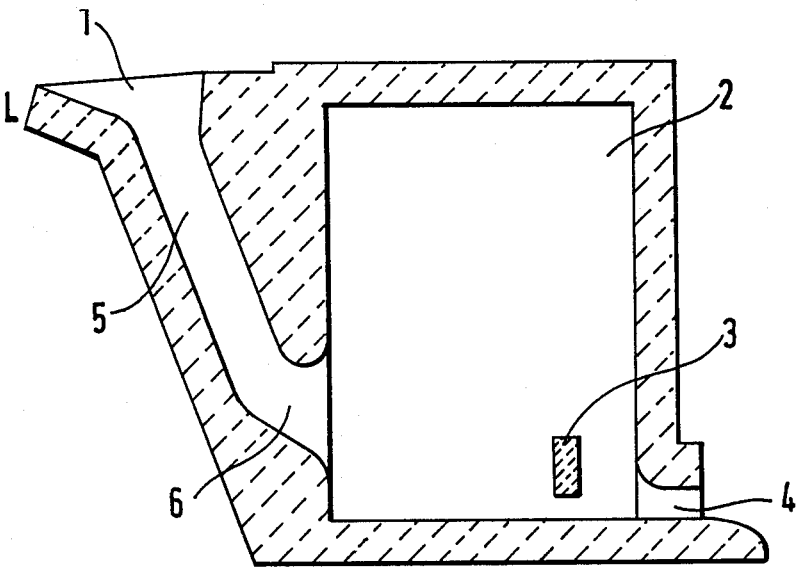
FIG. 3 is a vertical cross-section of a further embodiment of the metal treatment vessel according to the present invention.

FIG. 3 shows a further embodiment of a metal treatment vessel according to the present invention where a retaining means in the form of a brick 3 has been placed within the reaction chamber 2 to retain additive in the chamber against the flow of molten metal.

Figure 4:
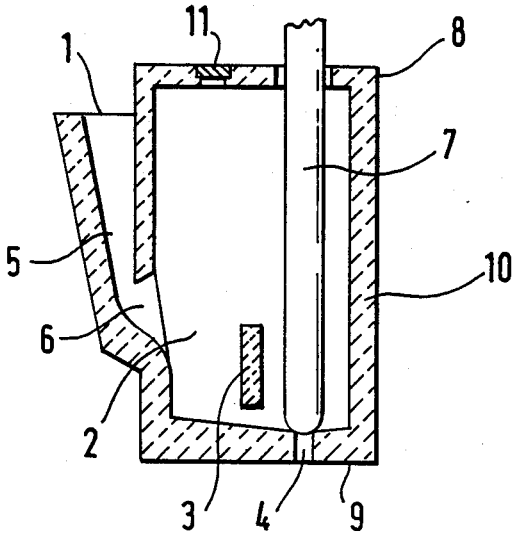
FIG. 4 is a vertical cross-section of a third embodiment of the metal treatment vessel according to the present invention.

FIG. 4 shows a metal treatment vessel which is provided with a stopper rod 7. In this drawing reference numerals 1 to 6 represent features corresponding to those in FIG. 3. The stopper rod 7 extends into the reaction chamber 2 and covers the outlet 4. The stopper rod 7 can be withdrawn to allow a flow of treated metal to pass through the outlet 4. The stopper rod 7 sits in the outlet 4 to prevent flow of metal until the level of molten metal reaches a predetermined height within the reaction chamber.

After a period of time reaction products other than treated metal will rise to the surface of the molten metal and the stopper rod 7 can then be withdrawn to allow a flow of molten metal which is substantially free of reaction products. By delaying the flow, clogging of the outlet 4 is reduced and hence the frequency of cleaning the vessel can also be reduced. The metal treatment vessel in FIG. 4 is divided into an upper section 8, a lower section 9 and a middle section 10. The sections 8, 9 and 10 can be jointed and clamped into position when the vessel is in use enabling the vessel to be separated when cleaning and maintenance is necessary. The vessel can also be provided with an inspection cover to allow the interior of the reaction chamber to be seen without opening out the vessel completely.

Figure 5:
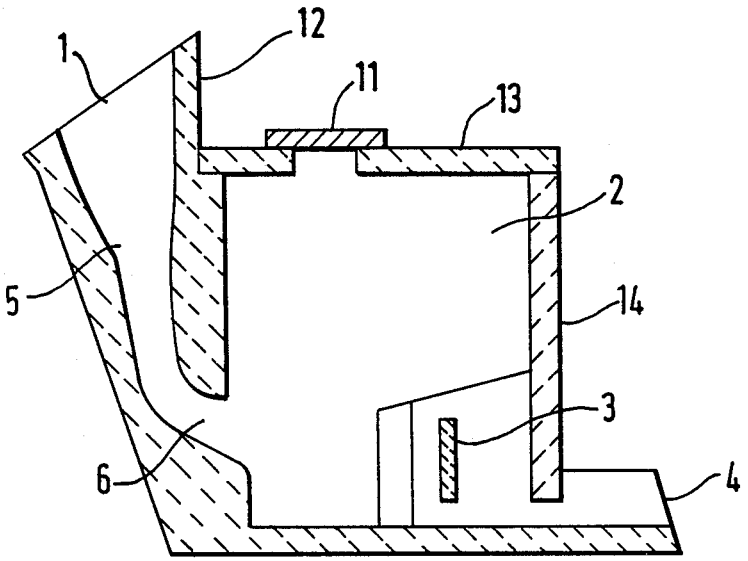
FIG. 5 is a vertical section of a fourth embodiment of the metal treatment vessel according to the present invention.

FIG. 5 shows a further embodiment of a metal treatment vessel according to the present invention. In this drawing reference numerals 1 to 6 represent features corresponding to those in FIG. 3. This embodiment of the present invention is further provided with a "splash" guard 12 at the mouth 1 of the inlet 5 to the vessel. The "splash" guard 12 ensures that, when the vessel is tilted to allow pouring of the treated metal from the outlet 4, the liquid metal in the inlet 5 will be prevented from "splashing" onto the lid 13 of the vessel.

The vessel depicted in FIG. 5 also has an inspection cover 11 which can be used to allow the interior of the reaction chamber to be seen without opening up the vessel completely. A further use for the inspection cover 11 would be to enable a continuous treatment process to be carried out within the vessel by introducing further additive through the inspection cover whenever the amount of additive needed replenishing.

Figure 6:
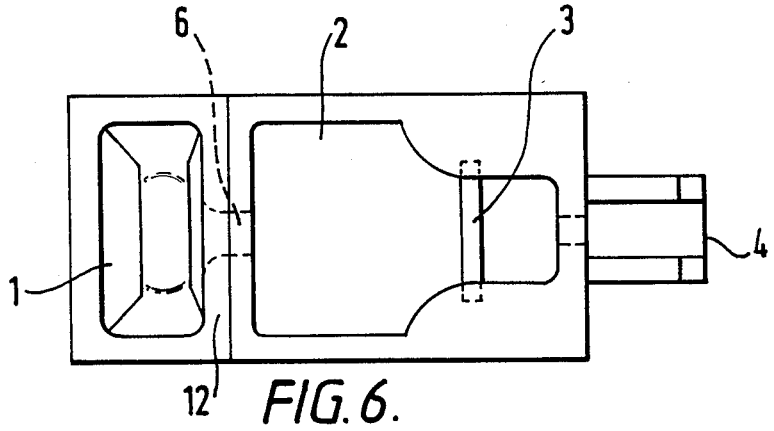
FIG. 6 is a view from above of the vessel in FIG. 5 with the lid removed.

The vessel shown in FIG. 5 is made from two sections —a body 14 and a lid 13. The lid 13 can be jointed and clamped into position when the vessel is in use and separated when the vessel is to be cleaned. FIG. 6 is a view from above of the vessel in FIG. 5 with the lid removed. In this figure one can see that the brick 3 (or refractory tile) is locked between the sides of the body 14 of the vessel.

The metal treatment vessel depicted in the drawings is made such that the diameter of the outlet is at least 10% less than the diameter of the inlet to ensure that the level of molten metal within the chamber 2 is sufficient to cover the end of the inlet 5 at the entrance to the chamber 2. A typical example of the diameters of the inlet and outlet would be 80 mm and 50 mm respectively.

The angle of the inlet at the point of entry 6 into the reaction chamber can vary and preferably lies within the range 30°–60° to the vertical.

The metal treatment vessel depicted in the drawings can be positioned adjacent to a holding chamber forming part of an auto pourer system. The holding chamber could also be provided with a stopper rod to control flow of the molten metal and if desired, a filter to remove any remaining reaction products from the treated metal.

The inlet 5 to the vessel should preferably have a mouth 1 of larger cross-section than the inlet to admit an inflow of molten metal which often "sprays" when poured into the vessel.

The metal treatment vessel shown in the drawings can be used to treat liquid iron. In this particular case, a magnesium containing alloy can be used to effect a change in the characteristics of the metal. Such an alloy changes the structure of the carbon, and depending upon the amount of alloy used, the carbon in the cast iron ma-y appear as spheroidal or vermicular graphite.

A treatment vessel according to the invention will in general be made by a technique generally known in the foundry art, that is by packing refractory into a casing formed for example of sheet steel the chambers being defined by formers which are removed after hardening of the refractory.

The following examples illustrate the invention:

EXAMPLES

In each of the examples which follow a treatment vessel according to a preferred embodiment of the invention was utilized. The vessel can be made with various treatment capacities depending on demand. An amount of the specified alloy (additive) expressed as a weight percentage of the pouring weight is introduced into the vessel through the inlet before pouring. The base iron which has been melted in an induction furnace of 5 ton capacity is poured in the weight indicated.

The magnesium yield given in each example is the amount of magnesium retained in the treated metal.

EXAMPLE 1

| | |
|---|---|
| Treatment vessel used | as shown in FIG. 3 |
| Base Iron Analysis; | Total carbon 3.6%;<br>Si 1.8%;<br>S 0.025%. |
| Weight of metal poured | 500 kg |
| Temperature | 1470–1480° C. |
| Alloy | Magnesium ferrosilicon containing 5% Mg + 1.6% Ca and available from Materials & Methods Ltd., of Reigate, Surrey, England under the designation PROCALOY ® 42 |
| Amount of Alloy | 1.6% by weight |
| Magnesium yield | 72% |
| Treatment time | 30 seconds |

EXAMPLE 2

| | |
|---|---|
| Treatment vessel used | as shown in FIG. 3 |
| Base Iron Analysis | as in Example 1 |

-continued

| | |
|---|---|
| Weight of metal poured | 1000 kg |
| Temperature | 1480° C. |
| Alloy | as in Example 1 |
| Amount of Alloy | 1.6% by weight |
| Magnesium yield | 70% |
| Treatment time | 45 seconds |

In this example the metal was poured in 2 runs each of 500 kg.

EXAMPLE 3

| | |
|---|---|
| Treatment vessel used | as shown in FIG. 3 |
| Base Iron Analysis | Total carbon 3.6%; Si 1.8%; S 0.02%. |
| Weight of metal poured | 500 kg |
| Temperature | 1500° C. |
| Alloy | as in Example 1 |
| Amount of Alloy | 1.8% by weight |
| Magnesium yield | 68% |

EXAMPLE 4

In this example a treatment vessel as shown in FIG. 3 of the drawings was utilized as indicated. This treatment vessel has a treatment capacity of 1000 kg.

The treated metal is fed directly into an automatic pouring system. Details are as follows:-

| | |
|---|---|
| Base Iron Analysis | Carbon 3.6%; Si 1.8%; S 0.015%. |
| Weight of metal poured | 600 kg |
| Temperature | 1480° C. |
| Alloy used | as in Example 1 |
| Amount of Alloy | 1.6% by weight |
| Magnesium yield | 64% |

EXAMPLE 5

This exemplifies treatment of metal fed to the treatment vessel directly from an electric furnace. The treated metal is then fed to a ladle.

The treatment vessel used is the same as that used in Example 4.

Treatment details are as follows:

| | |
|---|---|
| Base Iron Analysis | Carbon 3.6%; Si 1.8%; S 0.025% |
| Weight of metal poured | 600 kg |
| Temperature | 1530° C. |
| Alloy used | as in Example 1 |
| Amount of Alloy | 1.9% by weight |
| Magnesium yield | 50.5% |

EXAMPLE 6

The treatment vessel used is that shown in FIG. 5 and has a treatment capacity of 1000 kg.

| | |
|---|---|
| Base Iron Analysis | Carbon 3.7%; Si 2.0%; S 0.015%. |
| Weight of metal poured | 850 kg |
| Metal temperature in ladle | 1480° C. |
| Alloy used | 6–7% Mg and 0.5% Ca |

-continued

| | |
|---|---|
| Amount of Alloy | 1.5% by weight |
| Magnesium yield | 50–55% |
| Treatment time | 35 seconds. |

EXAMPLE 7

This exemplifies treatment of metal direct from the furnace to a ladle.

The treatment vessel used is that shown in FIG. 3 and has a capacity of 2000 kg.

Treatment details are as follows:

| | |
|---|---|
| Base Iron Analysis | Carbon 3.6%; Si 1.8%, S 0.01% |
| Weight of metal poured | 1500 kg |
| Furnace Temperature | 1500 kg |
| Treatment Temperature | 1475° C. |
| Alloy used | as in Example 1 |
| Amount of Alloy | 1.50% by weight |
| Magnesium yield | 64% |
| Treatment time | 42 seconds. |

Although the alloy used in the examples contains either 5% Mg or 6–7% Mg it is possible to use an alloy containing magnesium within the range of 3¾% to 10%.

I claim:

1. A metal treatment vessel having an inlet for the successive introduction of reactive additive and molten metal to be treated, a reaction chamber downstream of the flow of molten metal for successive receipt of the additive and the molten metal and an outlet downstream of the flow of metal in the reaction chamber; the inlet being provided with means for directing the additive and molten metal into the reaction chamber, the dimensions of the inlet to the reaction chamber and the outlet therefrom being such that in operation the molten metal rises in an overhead space provided in the reaction chamber to cover the additive and to seal off the inlet.

2. A metal treatment vessel as claimed in claim 1 in which there is provided a retaining means within the reaction chamber to retain the additive against the flow of molten metal.

3. A metal treatment vessel as claimed in claim 1 in which the inlet at the point of entry into the chamber is at an angle to the vertical whereby the additive and molten metal are deflected into the reaction chamber.

4. A metal treatment vessel as claimed in claim 1 in which the inlet is at an angle to the vertical whereby the additive and molten metal are deflected into the reaction chamber.

5. A metal treatment vessel as claimed in claim 1 in which the inlet has a mouth of larger cross-section to admit a large throw of molten metal.

6. A metal treatment vessel as claimed in claim 1 wherein the vessel further comprises a stopper rod which extends into the reaction chamber to cover the outlet in order to retain molten metal within the chamber for a period sufficient to allow reaction products to rise to the surface of the molten metal thus enabling a treated metal flow which is substantially free from reaction products.

7. A metal treatment vessel having an inlet for the successive introduction of reactive additive and molten metal to be treated, a reaction chamber downstream of the flow of molten metal for successive receipt of the additive and the molten metal and an outlet downstream of the flow of metal in the reaction chamber; the inlet being provided with means for directing the additive and molten metal into the reaction chamber, the dimensions of the inlet to the reaction chamber and the outlet therefrom being such that in operation the molten metal rises in an overhead space provided in the reaction chamber to cover the additive and to seal off the inlet; and retaining means being provided within the reaction chamber to retain the additive against the flow of molten metal; and in which the inlet at the point of entry into the chamber is at an angle to the vertical whereby the additive and the molten metal are deflected in the reaction chamber.

8. A metal treatment vessel as claimed in claim 7 wherein the reaction chamber is provided with a lid, which allows the vessel to be cleaned.

9. A metal treatment vessel as claimed in claim 7 wherein the upper portion of the reaction chamber is provided with an inspection cover.

10. A metal treatment vessel as claimed in claim 7 wherein the upper portion of the reaction chamber is provided with an inspection cover which allows further additive to be introduced into the reaction chamber.

11. A method for the treatment of a metal with a reactive additive which comprises introducing the additive into a closed reaction vessel at an angle to the vertical, the vessel having an inlet and an outlet, and a free overhead space, the outlet from the vessel being of smaller area than the inlet, retaining the additive in the vessel, introducing molten metal to be treated also at an angle to the vertical whereby it reacts with the retained additive and allowing the treated metal to run from the reaction vessel, optionally after retaining the treated metal in the reaction chamber for a predetermined period of time.

12. A method for the treatment of molten metal as claimed in claim 11 in which the metal is grey iron and the additive is a magnesium containing alloy, whereby iron in which the graphite is in vermicular or nodular form is obtained.

* * * * *